US007017964B2

(12) United States Patent
Hao

(10) Patent No.: US 7,017,964 B2
(45) Date of Patent: Mar. 28, 2006

(54) CHOPSTICK MANIPULATING DEVICE

(76) Inventor: Zhiguo Hao, 147-11 35th Flushing, New York, NY (US) 11354

( * ) Notice: Subject to any disclaimer, the term of this patent is extended or adjusted under 35 U.S.C. 154(b) by 169 days.

(21) Appl. No.: 10/371,926

(22) Filed: Feb. 20, 2003

(65) Prior Publication Data

US 2004/0164573 A1 Aug. 26, 2004

(51) Int. Cl.
*A47G 21/10* (2006.01)

(52) U.S. Cl. ..... 294/99.2; 294/1.1

(58) Field of Classification Search ..... 294/1.1, 294/16, 33, 99.2, 3, 8.5; 24/462, 499, 500, 24/530; 30/142, 150, 322; D7/642, 643–645, D7/648, 686

See application file for complete search history.

(56) References Cited

U.S. PATENT DOCUMENTS 3,323,825 A * 6/1967 Arima ..... 294/99.2
3,414,310 A * 12/1968 Ono ..... 294/99.2
3,501,191 A * 3/1970 Darr ..... 294/99.2
3,807,781 A * 4/1974 Rollband ..... 294/99.2
3,884,456 A * 5/1975 Lew ..... 294/99.2
4,199,180 A * 4/1980 Kelly ..... 294/33
4,312,530 A * 1/1982 Young ..... 294/99.2
4,787,663 A * 11/1988 Laramie ..... 294/99.2
4,826,227 A * 5/1989 Lew ..... 294/16
5,486,029 A * 1/1996 Kobayashi ..... 294/99.2
5,697,659 A * 12/1997 Calagui ..... 294/99.2
5,810,411 A * 9/1998 Major ..... 294/99.2
6,749,239 B1 * 6/2004 Choi ..... 294/99.2

* cited by examiner

*Primary Examiner*—Eileen D. Lillis
*Assistant Examiner*—Paul T. Chin
(74) *Attorney, Agent, or Firm*—Collard & Roe, P.C.

(57) ABSTRACT

A chopstick manipulating device includes a resilient connecting member having a pair of inwardly angled side members and a bottom portion extending therebetween to form a triangular member with an open top. A pair of chopstick keepers have coplanar substantially triangular-shaped board portions disposed on the rear of board member and outwardly extending posts disposed on an outer corner of the substantially triangular-shaped board portions. Elastic boards extend outwardly from a top portion of the board members. A back surface of each of the board members of the chopstick keepers is coupled to an outer surface of a respective side member of the resilient connecting member. The respective board member, post and elastic board define an open channel for releasably and slidably securing a chopstick against the triangular-shaped board portion. The chopsticks pivot as the resilient connecting member is opened and closed.

6 Claims, 4 Drawing Sheets

CHOPSTICK MANIPULATING DEVICE

BACKGROUND OF THE INVENTION

This invention relates to a holder, more specifically, a holder to fix a pair of chopsticks to assist people in using chopsticks to eat more easily.

For some people, it is unfamiliar or difficult to use chopsticks to eat. Previously, many devices have been invented to assist these people in using chopsticks. With these devices, some people improve their skill and feel a little more confident using chopsticks. But compared with each other, some devices are a little expensive; some devices are only suitable for special chopsticks with special shapes and sizes; some devices are not easy to fix chopsticks thereon or have holes through which an end of the chopsticks that will soon hold food must be passed; and some devices have some problems when people are using them, two examples are as follows: sometimes it fails to pick up food as the chopsticks cross; sometimes the food is dropped from chopsticks when the food is already picked up and lifted because the food slips between the chopsticks. Accordingly, it is necessary to invent new devices to assist people in using chopsticks. It is an object of this invention to provide a chopstick holder that will deal with all of the above situations.

BRIEF SUMMARY OF THE INVENTION

A device for using chopsticks comprises a pair of chopstick keepers and a resilient connecting member. The chopstick keeper is channel shaped with an elastic board on the side. When a chopstick is put into the channel, the pressure and static friction from the elastic board fix the chopstick firmly in the chopstick keeper. The resilient connecting member may be formed with three boards and is triangle shaped with an opened top angle. A pair of chopstick keepers symmetrically connects two wall boards of a resilient connecting member back to a back. When using chopsticks to pick up food, pressure should be put on the chopsticks, which makes a resilient connecting member open wide and elastically deform. When the pressure is removed, the resilient connecting member closes and returns the chopsticks to their usual shape by elasticity.

| REFERENCES NUMERALS IN DRAWINGS | |
|---|---|
| 10 chopstick holder | 12 board |
| 14 triangle board | 16 post |
| 18 top angle of triangle board | 20 chopstick keepers |

-continued

| REFERENCES NUMERALS IN DRAWINGS | |
|---|---|
| 22 bottom side of triangle board | 24 elastic board |
| 26 back surface of board | 28 bottom board |
| 30 resilient connecting member | 32 wall board |
| 34 outside surface of wall board | 36 free side of wall board |
| 38 top angle of resilient connecting member | 40 chopstick |
| 42 top end of chopstick | 44 bottom end of chopstick |
| 46 object | |

DETAILED DESCRIPTION OF THE PREFERRED EMBODIMENTS

Figure 1:
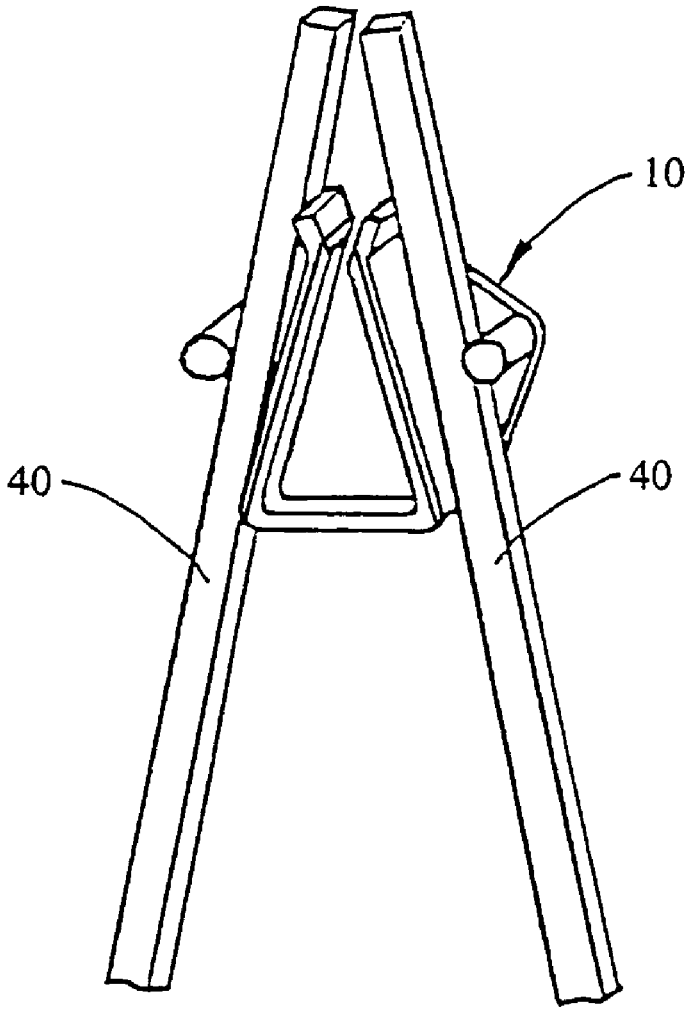
FIG. 1 is a front perspective view of a chopstick holder with chopsticks.

As shown in FIG. 1, a pair of chopsticks 40 is fixed on a chopstick holder 10.

Figure 2:
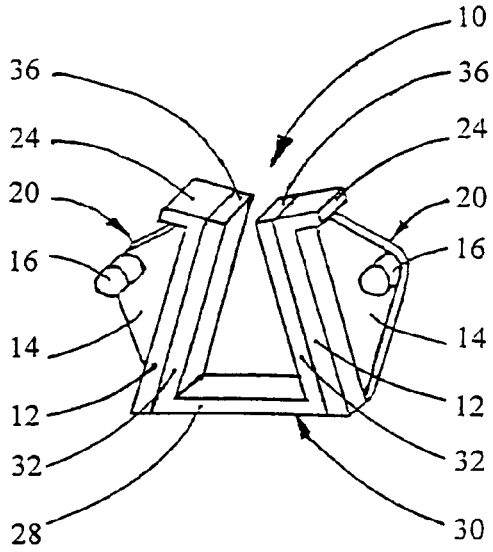
FIG. 2 is a front perspective view of a chopstick holder.

As shown in FIG. 2, a chopstick holder 10 comprises a pair of chopstick keepers 20 and a resilient connecting member 30. The resilient connecting member and the chopstick keepers may be made from a plastic or metal material.

Figure 3:
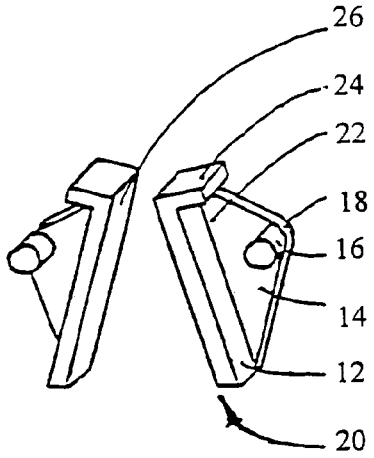
FIG. 3 is a front perspective view of a pair of the chopstick keepers illustrated in FIG. 2.

As shown in FIG. 3, a chopstick keeper 20 comprises a board 12, a triangle board 14, a post 16 and an elastic board 24. The triangle board 14 is vertically connected to the board 12. The side of the board 12 and bottom side of triangle board 22 are connected. The post 16 is vertically connected to the triangle board 14. An end of post 16 is connected to the top angle of triangle board 18. The post 16 and the board 12 are parallel and at the same side of triangle board 14. The elastic board 24 is diagonally connected to the board 12. The side of elastic board 24 and the side of board 12 are connected. The post 16 and the elastic board 24 are parallel and at the same side of the board 12.

Figure 4:
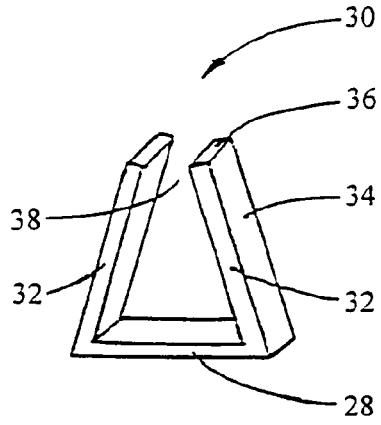
FIG. 4 is a front perspective view of a resilient connecting member illustrated in FIG. 2.

As shown in FIG. 4, a resilient connecting member 30 comprises a bottom board 28 and a pair of wall boards 32. The two wall boards 32 are respectively, symmetrically and diagonally connected to the bottom board 28. One side of each of the wall boards 32 is connected to an opposite side of the bottom board 28. A pair of wall boards 32 and the bottom board 28 form a triangle shape and a top angle of resilient connecting member 38 is open.

As shown in FIG. 2, a pair of chopstick keepers 20 is symmetrically connected to a resilient connecting member 30. Each back surface of board 26 as shown in FIG. 3 is connected to each outside surface of wall board 34 as shown in FIG. 4. The post 16 and bottom board 28 are parallel. The elastic board 24 is at a free side of wall board 36. Two triangle boards 14 are at a same plane and two posts 16 are at a same side of that plane.

Figure 5:
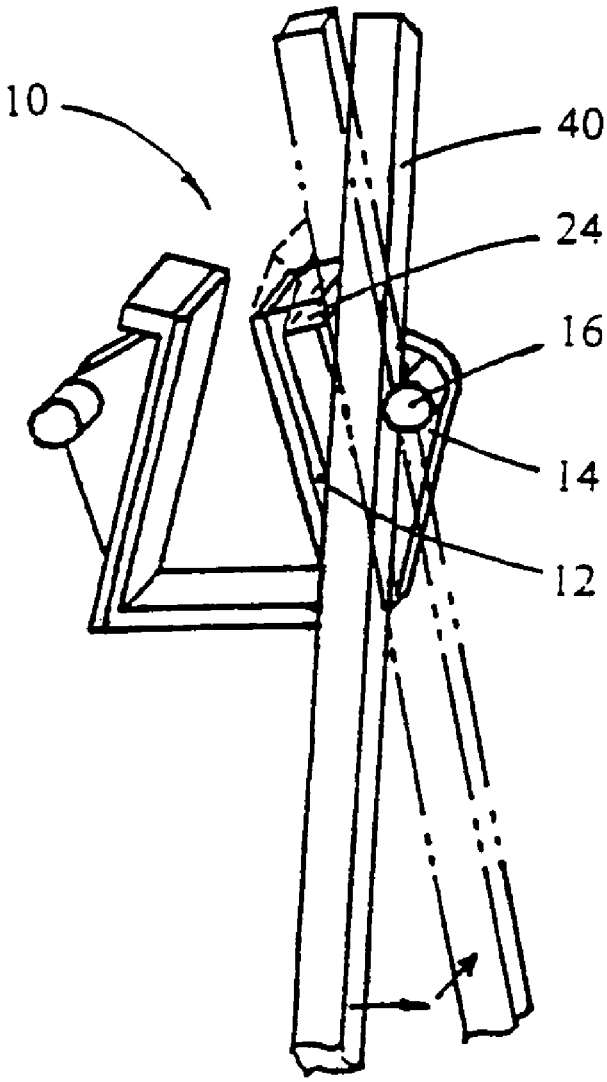
FIG. 5 is a front perspective view of a chopstick holder with a chopstick.

As shown in FIG. 5, when fixing a pair of chopsticks 40 on a chopstick holder, the user could set more than a half part of chopstick 40 between the elastic board 24 and the post 16, rotate the chopstick 40 around the post 16 until the chopstick 40 and the board 12 are parallel, put the chopstick 40 toward the triangle board 14, and make the chopstick 40 nestle closely to the triangle board 14.

Figure 6:
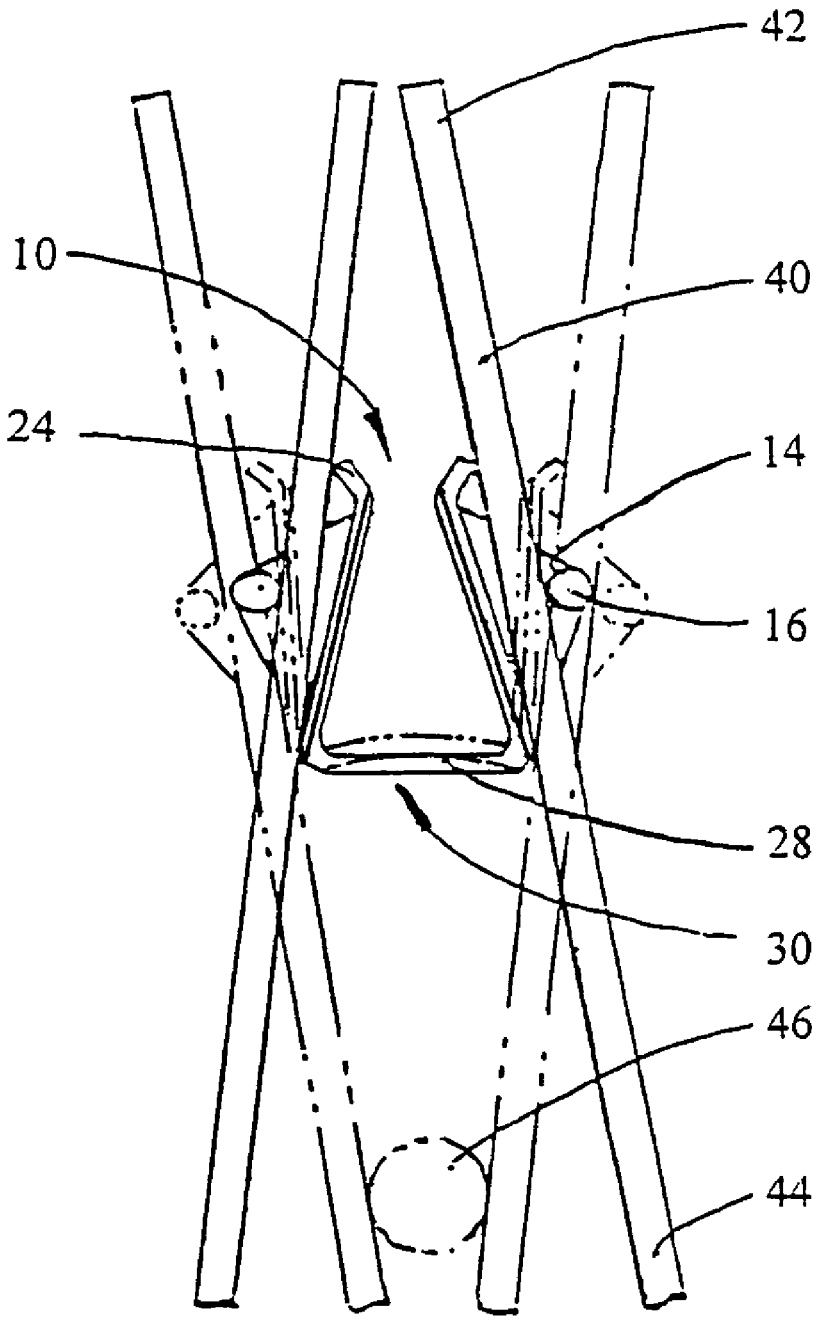
FIG. 6 is a front view of a chopstick holder with chopsticks.

As shown in FIG. 6, when the chopsticks 40 are fixed in chopstick holder 10, the elastic boards 24 have elastic deformation and apply pressure to the chopsticks 40. The pressure causes static friction to resist chopsticks 40 from moving.

As shown in FIG. 6, when using chopstick holder 10, the user should put pressure on the chopsticks 40 just below the bottom board 28 with their finger. The chopsticks 40 rotate around the bottom board 28. The bottom ends of chopsticks 44 get close and hold an object 46. The chopsticks are in a V-shape that prevents the object 46 from slipping down between the chopsticks 40 so that the object 46 is not easily dropped from the chopsticks 40. When the chopsticks 40 are rotating, the top end of chopsticks 42 opens wide. The chopsticks 40 put pressure on the posts 16, making resilient connecting member 30 open wide by elastic deformation. When the user removes the pressure by their finger, the resilient connecting member 30 closes and returns the chopsticks 40 to their usual shape by elasticity. As the chopsticks 40 nestle closely to the triangle boards 14 and the two triangle boards 14 are in the same plane, whenever closing or opening, the chopsticks 40 are always in the same plane, which prevents the bottom end of chopsticks 44 from crossing and is helpful in picking up object 46.

Accordingly, this invention has the following advantages:

(1) This chopstick holder could be used with various chopstick styles and is not limited to one kind of shape and size of chopsticks. It can be used with many kinds of chopsticks such as square, circle, rectangle, oval, etc.;

(2) This chopstick holder is easy to put chopsticks thereon and avoids touching the bottom end of the chopsticks that will contact food;

(3) This chopstick holder can be shifted up or down along the chopsticks and, the nearer the distance between the chopstick holder and the bottom end of the chopsticks, the easier it is to pick up food without the bottom end of the chopsticks crossing and without dropping the food;

(4) This chopstick holder is inexpensive to manufacture and could be used repeatedly.

Although the description above contains much specificity, it should not be construed as limiting the scope of the invention but as merely providing illustrations of the presently preferred embodiments of this invention. For example, the triangle board could have other shapes such as half circle, rectangle, etc.; the post could be many kinds of shapes such as a circle, square, rectangle, oval, etc.; the bottom board could have a curved surface; the bottom board could have a hollow on its free side so that chopstick holder could be used as a chopstick seat.

Accordingly, the scope of the invention should be determined not by the embodiment illustrated; but by the appended claims and their legal equivalents.

I claim:

1. A device for manipulating a pair of chopsticks, the device comprising:

a) a resilient connecting member comprising:

i) a pair of inwardly angled side members comprising a first side member and a second side member, each having a bottom portion and an outer surface; and ii) a bottom member extending between said bottom portion of said first side member and said bottom portion of said second side member to form a substantially triangular-shaped member having an open top; and b) a pair of chopstick keepers, comprising:

i) a first board member having a top portion, a rear portion and a back surface, wherein said back surface of said first board member is coupled to said outer surface of said first side member;

ii) a second board member having a top portion, a rear portion and a back surface, wherein said back surface of said second board member is coupled to said outer surface of said second side member;

iii) a first elastic board disposed at and extending outwardly from said top portion of said first board member;

iv) a second elastic board disposed at and extending outwardly from said top portion of said second board member;

v) a first substantially triangular-shaped board portion disposed on said rear portion of said first board member substantially perpendicular to said back surface of said first board member;

vi) a second substantially triangular-shaped board portion disposed on said rear portion of said second board member and coplanar with said first substantially triangular-shaped board portion;

vii) a first post disposed at and extending out from an outer corner of said first substantially triangular-shaped board portion; and viii) a second post disposed at and extending out from an outer corner of said second substantially triangular-shaped board portion;

wherein said first board member, said first post and said first elastic board define a first open channel for receiving one of the pair of chopsticks and said one of the pair of chopsticks is releasably and slidably secured in said first open channel against said first substantially triangular-shaped board portion;

wherein said second board member, said second post and said second elastic board define a second open channel for receiving another of the pair of chopsticks and said another of the pair of chopsticks is releasably and slidably secured in said second open channel against said second substantially triangular-shaped board portion; and wherein the pair of chopsticks pivot as said resilient connecting member is opened and closed.

2. The device for manipulating a pair of chopsticks according to claim 1 wherein said first elastic board and said second elastic board are flat.

3. The device for manipulating a pair of chopsticks according to claim 1, wherein said resilient connecting member is made from a plastic.

4. The device for manipulating a pair of chopsticks according to claim 1, wherein said resilient connecting member is made from a metal.

5. The device for manipulating a pair of chopsticks according to claim 1, wherein said pair of chopstick keepers are made from a plastic.

6. The device for manipulating a pair of chopsticks according to claims 1, wherein said pair of chopstick keepers are made from a metal.

* * * * *